United States Patent [19]

Imamura et al.

[11] Patent Number: 4,480,665

[45] Date of Patent: Nov. 6, 1984

[54] WEFT-BAR (SET MARK) PREVENTION SYSTEM FOR A LOOM

[75] Inventors: Shuichiro Imamura; Akira Arakawa, both of Tokyo, Japan

[73] Assignee: Nissan Motor Company, Limited, Yokohama, Japan

[21] Appl. No.: 428,666

[22] Filed: Sep. 29, 1982

[30] Foreign Application Priority Data

Jan. 21, 1981 [JP] Japan ..... 57-6754
Nov. 27, 1981 [JP] Japan ..... 56-189083

[51] Int. Cl.[3] ..... D03D 49/14

[52] U.S. Cl. ..... 139/97; 139/110; 139/115

[58] Field of Search ..... 139/114, 115, 97, 110, 139/1 R

[56] References Cited

U.S. PATENT DOCUMENTS

| | | | |
|---|---|---|---|
| 2,551,920 | 5/1951 | Willis et al. | 139/115 X |
| 2,556,055 | 6/1951 | Bohan | 139/97 |
| 2,571,510 | 10/1951 | Willis et al. | 139/115 |
| 2,737,209 | 3/1956 | Meyer | 139/115 X |
| 3,495,631 | 2/1970 | Sakamoto | 139/97 |
| 4,364,002 | 12/1982 | Suzuki et al. | 139/1 R |

FOREIGN PATENT DOCUMENTS

| | | | |
|---|---|---|---|
| 130603 | 12/1959 | U.S.S.R. | 139/97 |

*Primary Examiner*—James Kee Chi

*Attorney, Agent, or Firm*—Schwartz, Jeffery, Schwaab, Mack, Blumenthal & Koch

[57] ABSTRACT

A weft-bar (set mark) prevention system for a loom which can prevent a weft-bar caused when the loom is immediately restarted, after the loom has been stopped due to weft- or warp-thread cut (i.e., breakage of a weft or warp thread). When the loom is restarted from the closed-shed state, a greater additional warp tension is applied to the warp threads; when the loom is started from the open-shed state, a smaller additional warp tension is applied to the warp threads. After one or two cycles of the loom motion, the above-mentioned additional warp tensions are not applied, because the main motor is in a stable condition. The system according to the present invention comprises an optical loom-starting angle sensor for detecting whether the loom is started from the closed-shed or open-shed, a counter for determining at least one initial cycle during which warp tension is controlled, air cylinder to push the easing lever in the direction to increase warp tension.

10 Claims, 8 Drawing Figures

ANGULAR RANGE SIG.
WARP TENSION SIG.
CLOSE
OPEN
SELECTOR
MULTI
DRIVER
COUNTER
PROX'TY SW
TIMING SIG.
ACTUATOR DRIVE SIG.
(CLOSED SHED)
(OPEN SHED)
AUX DEVICES
START SW
SET SW
TIMER
3-WAY V
HIGH-P V
LOW-P V
STOP CIRCUIT
A
B
C
D
E
F
G
H

ANGULAR RANGE SIG.
WARP TENSION SIG. (L: CLOSED; H: OPEN)
CLOSED
OPEN
SELECTOR
TIMING SIG.
MULTI
DRIVER
COUNTER
PROX'TY SW
(OPEN SHED)
AUX DEVICES
3-WAY V
P V
TIMER
STOP CIRCUIT
A
B
C
D
E
F
H

WEFT-BAR (SET MARK) PREVENTION SYSTEM FOR A LOOM

BACKGROUND OF THE INVENTION

1. Field of the Invention

The present invention relates generally to a weft-bar (set mark) prevention system for a loom and more specifically to a system for preventing the heavy or light weft (filling) bar caused when a loom is restarted, after the loom has been stopped due to weft or warp thread cut (weft or warp thread breakage).

2. Description of Prior Art

In a loom, as is well-known, warp threads let-off from warp beams are guided and introduced to the cloth fell under an appropirate tension applied thereto by the aid of an elastically supported guide member, for instance, such as a back roller. In such a loom, however, if the loom is stopped due to some reasons such as warp cut or weft cut (i.e., breakage of the warp or weft thread) and if it takes a time before starting the loom again, since the warp threads are left as they are under tension, the warp threads are stretched and become somewhat elongated.

If the warp threads are elongated, since the cloth fell moves frontward (toward the breast beam side), when the loom is restarted, there exists light weft-bar in the initial several picks. A weft-bar is also known as a set mark.

Additionally, when the loom is restarted, the initial several picking motions (the first picking motion, in particular) are performed while the speed of the main motor is increasing, the speed of the reed is lower than in the stable state. Furthermore, when the loom is restarted, since the frontward deflection (deformation) of the reed caused by the reed inertia and reed elasticity when the reed beats the weft is smaller than in the stable state, the reed is positioned more rearward than in the stable state at the beat-up stage, thus causing a light weft-bar when the loom is restarted.

Two overcome this problem, there has been proposed a method of preventing the light weft-bar which involves intentionally increasing the tension applied to the warp threads by tension increasing means during the initial several picks after the loom has been restarted, in order to adjust the position of cloth fell.

By way of background, the loom is stopped when a warp thread is cut or a weft thread is not inserted correctly. In the case of warp thread cut, the loom is usually repaired in the state where the warp threads are closed (in a closed-shed state); in the case of weft thread cut, the loom is usually repaired in the state where the warp threads are opened (in an open-shed state). Therefore, when the loom is restarted beginning from the motion angle at which the loom has just been repaired, the loom-restarting angle in the case of warp thread cut is different from that in the case of weft thread cut.

On the other hand, since the initial revolution speed of the reed drive shaft at the beat-up stage increasingly varies at the first picking motion according to the loom-restating angle, the degree of the reed deflection differs. Therefore, in the case where a tension to be applied to the warp threads is predetermined to be an appropriate value required when the loom is restarted beginning from the closed-shed state, the weft bar tends to be heavy when the loom is restarted beginning from the open-shed state (the first pick motion is attained after one empty beat-up motion). In the case where a tension to be applied to the warp threads is predetermined to be an appropriate value required when the loom is restarted beginning from the open-shed state, the weft bar tends to be light when the loom is restarted beginning from the closed-shed state.

In practice, accordingly, it is necessary to restart the loom beginning from the same predetermined loom-restarting angle. As a result, when the loom has been repaired at an angle different from this predetermined angle, it is necessary to move the loom manually to this predetermined angle before restarting, thus complicating the procedure.

SUMMARY OF THE INVENTION

With these problems in mind, therefore, it is the primary object of the present invention to provide a weft-bar prevention system for a loom which can prevent a weft-bar even if the loom is restarted from any motion angle of the loom, after the loom has been repaired, without adjusting the loom to a predetermined angle manually.

Therefore, in the system according to the present invention, the weft-bar is automatically prevented if the loom is restarted from warp thread cut (closed-shed state) or from weft thread cut (open-shed state).

To achieve the above-mentioned object, in the weft-bar prevention system according to the present invention, it is first detected whether the loom is started from the closed-shed state or from the open-shed state. When the loom is restarted from the closed-shed state, a greater additional warp tension is applied to the warp threads; when the loom is restarted from the open-shed state, a smaller additonal warp tension is applied to the warp threads. After one or two cycles have been completed in the loom motion, the above-mentioned additonal warp tensions are relaxed, returning to the orignal warp tension, because the main motor is in a stable condition.

The weft-bar prevention system according to the present invention comprises loom-starting angle detection means for detecting angular ranges from which the loom is started, warp tension selection means for selecting one of the warp tension signals, initial-cycle determination means for determining the initial cycles during which warp tension is controlled, actuator driving means for outputting actuator driving signals, and warp-tension increasing means for increasing tension to be applied to the warp threads.

The above-mentioned various means are devices, sections or elements activated optically, electrically or pneumatically, as described in more detail hereinafter.

BRIEF DESCRIPTION OF THE DRAWINGS

The features and advantages of the weft-bar prevention system for a loom according to the present invention will be more clearly appreciated from the following description of the preferred embodiments of the invention taken in conjunction with the accompanying drawings in which like reference numerals designate the same or similar elements or sections throughout the figures thereof and in which.

DETAILED DESCRIPTION OF THE PREFERRED EMBODIMENTS

In view of the above description, reference is now made to a first embodiment of the weft-bar prevention system for a loom according to the present invention.

Further, in this specification, weft-bar means difference in cloth level due to diference in weft beating-up motion, that is, a set mark.

Figure 1:
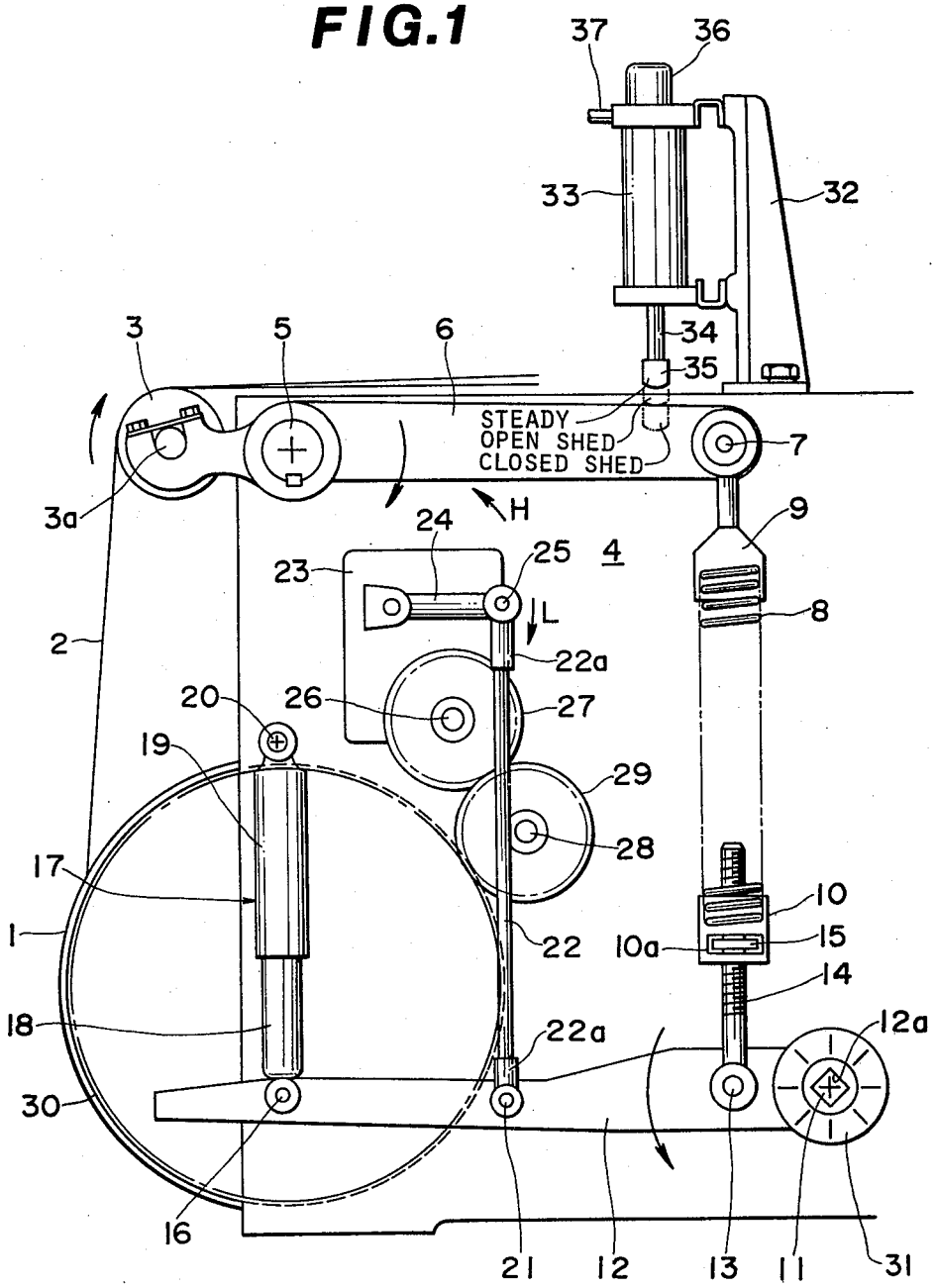
FIG. 1 is a fragmentary side view of a loom showing an essential mechanism portion of a first embodiment of the weft-bar prevention system according to the present invention.

In FIG. 1, the reference numeral 1 denotes a warp beam, the reference numeral 2 denotes warp threads, and the reference numeral 3 denotes a back roller. The warp threads 2 let-off from the warp beam 1 are guided by the back roller 3 to the cloth fell after being passed through a heald (not shown) and a reed (not shown).

The back roller 3 is rotatably supported by an back roller axle 3*a* at one end portion of an easing lever 6, the intermediate portion of which is fixed to an easing lever axle 5 rotatably supported on a frame 4 of a loom. At the other end portion of the easing lever 6, there is provided a pin 7 to which a support bracket 9 attached to one end portion of a tension spring 8 is rotatably supported. At the other end portion of the tension spring 8, there is provided a support bracket 10 into which a threaded rod 14 is screwed with a nut 15 disposed within an opening 10*a* formed in the support bracket 10. The reference numeral 11 denotes a square axle of a torsion bar fixed to the frame 4. The reference numeral 12 denotes a tension lever, the square-opening 12*a* of which is fixedly fitted to the square axle 11 of the torsion bar. One end of the threaded rod 14 is rotatably connected to a pin 13 provided for the tension lever 12. The tension lever 12 is rotatably connected to a piston rod 18 of an hydraulic damper 17 via a pin 16 provided near the end portion of the tension lever 12. Further, a cylindrical casing 19 of the hydraulic damper 17 is also rotatably supported by a pin 20 fixed to the frame 4.

The reference numeral 22 denotes a variable speed gear rod, one end of which is rotatably connected to a pin 21 provided for the tension lever 12 and the other end of which is also rotatably connected to a pin 25 fixed to a variable speed gear lever 24 of a stepless variable speed gear 23. The reference numeral 22*a* denotes two rod-length adjusting members provided at either end portion of the rod 22, respectively. The stepless variable speed gear 23 changes the speed-gear ratio according to the position of the gear lever 24; that is, when the lever 24 is rotated counterclockwise (H in FIG. 1), the variable speed gear 23 transmits a rotational force at a higher revolution speed; when rotated clockwise (L in FIG. 1), the variable speed gear 23 transmits a rotational force at a lower revolution speed. The driving shaft or the input shaft (not shown) of the variable speed device 23 is linked to the main motor of the loom. To the driven shaft or the output shaft 26 of the variable speed device 23, a gear wheel 27 is fixed so as to engage with another gear wheel 29 fixed to a shaft 28 rotatably supported on the frame 4. The other gear wheel fixed to this shaft 28 on the inside of the frame 4 (not shown) engages with a large-diameter gear wheel 30 fixed to the inside surface of the warp beam 1 to rotate the beam 1.

The operation of the mechanism described above is as follows. First, the torsion bar 11 is rotated clockwise (in FIG. 1) to an angle predetermined according to the kinds of warp threads 2, while watching a dial gauge 31 mounted on the frame 4 of the loom. Therefore, the reactive rotational force of the torsion bar 11 urges the tension lever 12 counterclockwise; that is, a counterclockwise bias moment is always applied to the tension lever 12, because the tension lever 12 is fixedly fitted to the torsion bar with the square opening 12*a* of the tension lever 12 fitted to the square shaft 11 of the torsion bar. Therefore, the easing lever 6 is reversely urged clockwise by this torsional force via the tension spring 8, with the result that a tension is applied to the warp threads 2 via the back roller 3, as shown by the arrows in FIG. 1.

When shedding motion begins, although the tension applied to the warp threads 2 changes and thus oscillates the easing lever 6 via the back roller 3, the change in tension is damped by the aid of the tension spring 8 and the hydraulic damper 17, without oscillating the tension lever 12.

On the other hand, when cloth is woven and therefore the diameter of the wound warp threads in the warp beam 1 decreases, the letting-off speed of the warp thread 2 from the warp beam 1 is reduced, so that the tension applied to the warp thread 2 increases. In this case, since the warp thread 2 rotates the easing lever 6 counterclockwise via the back roller 3, the tension lever 12 is rotated clockwise via the tension spring 8. As a result, the rod 22 is moved upward; the variable speed gear lever 24 of the stepless variable speed gear 23 rotates counterclockwise; the reduction speed ratio decreases; the revolution speed of the warp beam 1 increases; and, therefore, the tension applied to the warp threads 2 is adjustably corrected.

In addition to the above-mentioned mechanism, in the weft-bar prevention system according to the present invention, an air cylinder 33 is additionally provided being supported by a bracket 32 mounted vertically on the frame 4 in such a way that a contact member 35 fitted to the end of the piston rod 34 can be brought into contact with the easing lever 6.

When the loom is moving in a steady state, the air cylinder 33 is released to atmospheric pressure and therefore the contact member 35 of the air cylinder 33 is kept away from the easing lever 6 by the force of a spring 38, without applying any additional tension to the warp threads. When the loom is moving in a transitional state; that is, when the loom is started, the air cylinder 33 is activated by pressurized air and therefore the contact member 35 of the air cylinder 33 is brought into contact with the easing lever 6 to apply an additional tension to the warp threads. Further, in this case, by controlling the pressure applied into the air cylinder, it is possible to control the degree of tension applied to the warp threads. In more detail, in this embodiment, high-pressure air is introduced into ther air cylinder to apply greater additional tension to the warp threads in the case where the loom is restarted from the closed-shed state; low-pressure air is introduced into the air cylinder to apply smaller additional tension to the warp threads in the case where the loom is restarted from the open-shed state, as depicted in FIG. 1.

Figure 2:
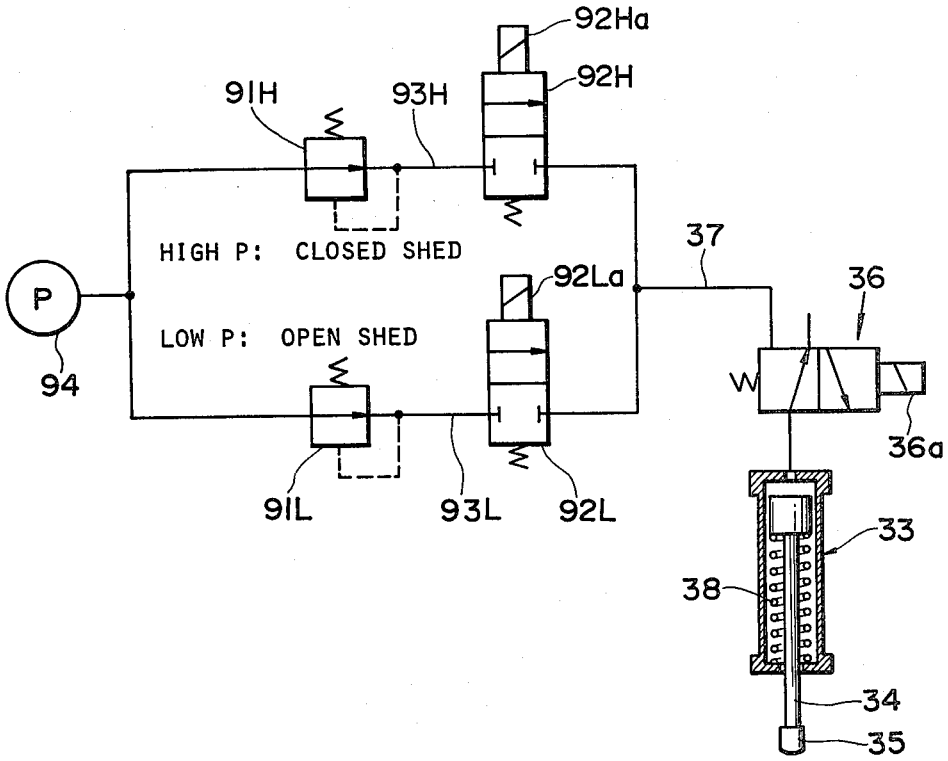
FIG. 2 is a diagram of a pneumatic system for supplying a pressurized air to an air cylinder shown in FIG. 1.

FIG. 2 is a diagram of a pneumatic system for supplying a pressurized air into the air cylinder 33.

In the figure, the reference numeral 91H denotes a high-pressure governor, the reference numeral 91L denotes a low-pressure governor, the reference numeral 92H denotes a high-pressure electromagnetic valve actuated by a high-pressure valve solenoid 92H*a*, the reference numeral 92L denotes a low-pressure electromagnetic valve actuated by a low-pressure valve solenoid 92L*a*, the reference numeral 93H denotes a high-pressure pneumatic line, the reference numeral 93L denotes a low-pressure penumatic line, the reference numeral 94 denotes a pressurized-air supply source.

The air cylinder 33 is connected to a pressurized air supplying pipe 37 via a three-way electromagnetic valve 36. The three-way electromagnetic valve 36 releases the pressure within the pressure chamber of the air cylinder 33 to atmospheric pressure when deenergized, so that the piston rod 34 of the air cylinder 33 is pulled into the cylinder by the force of a spring 38 housed therewithin; however, when the three-way valve solenoid 36*a* is energized, the three-way electromagnetic valve 36 introduces the pressure in the air supplying pipe 37 into the pressure chamber of the air cylinder 37, so that the piston rod 34 of the air cylinder 33 is pushed out in order that the contact member 35 of the piston rod 34 rotates the easing lever 6 clockwise.

The pressurized-air supplying pipe 37 is bifurcated so as to communicate with the high-pressure governor 91H via the high-pressure electromagnetic valve 92H and with the low-pressure governor 91L via the low-pressure electromagnetic valve 92L. The pressure determined in the high-pressure governor 91H is of course higher than that in the low-pressure governor 91L. The two electromagnetic valves 92H and 92L are normally closed but opened when the solenoid 92H*a* or 92L*a* is energized.

Therefore, when the high-pressure solenoid 92H*a* and the three-way valve solenoid 36*a* are both energized, a high-pressure is supplied to the air cylinder 33 to strongly push the piston rod downward, that is, to rotate the easing lever clockwise for applying a higher tension to the warp threads; on the other hand, when the low-pressure solenoid 92L*a* and the three-way valve solenoid 36*a* are both energized, a low-pressure is supplied to the air cylinder 33 to weakly push the piston rod downward, that is, to rotate the easing lever clockwise for applying a lower tension to the warp threads.

Figure 3:
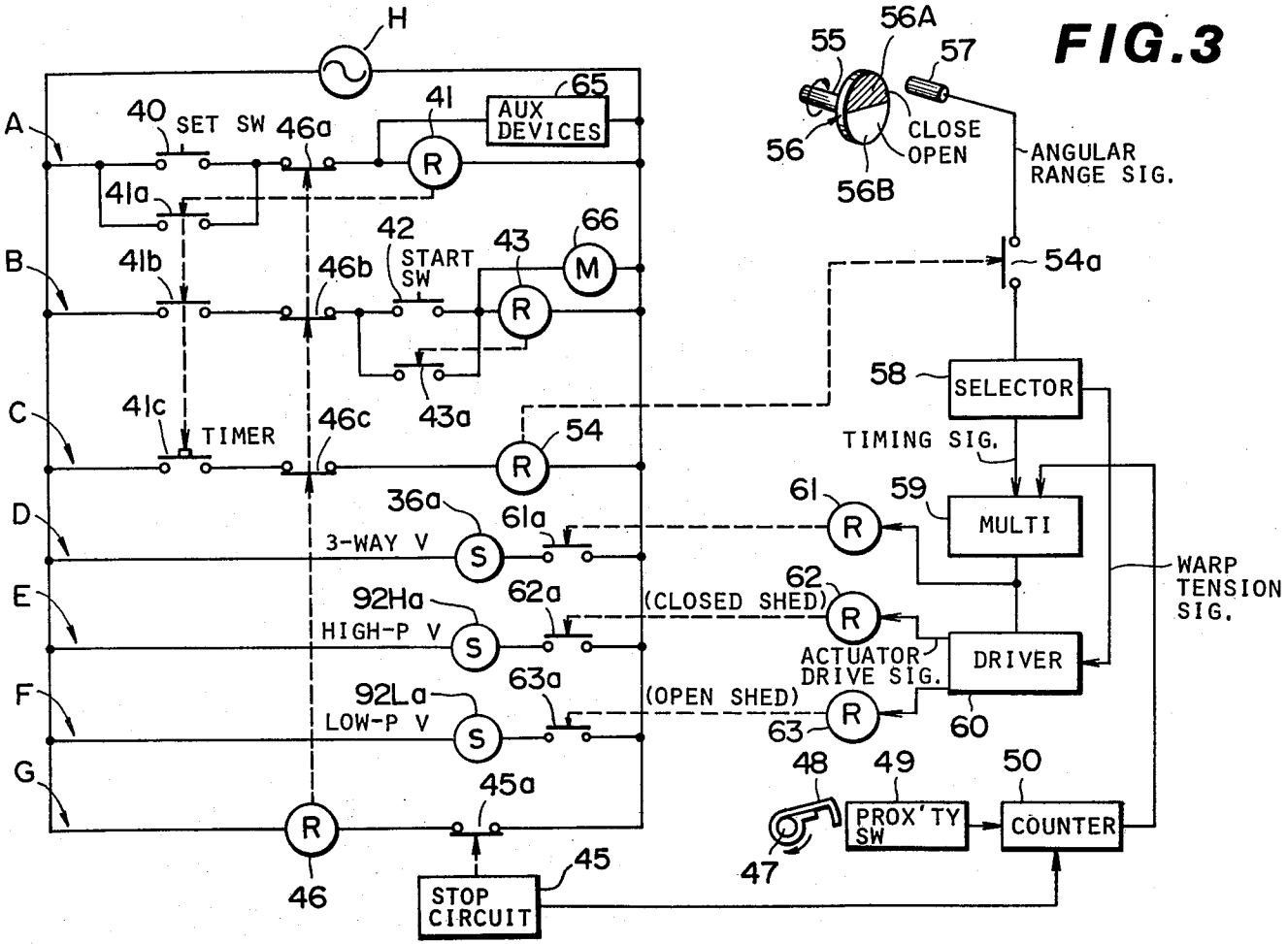
FIG. 3 is a diagram of a circuit for actuating electromagnetic valves to supply high or low pressurized air and a three-way electromagnetic valve shown in FIG. 2, in order to increase warp tension.

A description of the circuit for actuating the three-way electromagnetic valve 36 and the high- and low-pressure electromagnetic valves 92H and 92L follows, with reference to FIG. 3. In the current path A, a normally-open automatically-reset type push button set switch 40 for starting auxiliary devices 65 (blower, etc.) and a normally-closed contact 46*a* of a relay 46 (explained later) and a relay 41 are connected in series. Further, a normally-open contact 41*a* of the relay 41 is connected in parallel with the switch 40. In the current path B, a normally-open contact 41*b* of the relay 41, a normally-closed contact 46*b* of the relay 46, a normally-open automatically-reset type push button start switch 42 for driving a main motor 66, and a relay 43 are connected in series. Further, a normally-open contact 43*a* of the relay 43 is connected in parallel with the switch 42. In the current path C, a built in timer type normally-open contact 41*c* of the relay 41, a normally-closed contact 46*c* of the relay 46 and a relay 54 are connected in series.

Further, in the current path D, a solenoid 36*a* of the three-way electromagnetic valve 36, and a normally-open contact 61*a* of a relay 61 (explained later) are connected in series. In the current path E, a solenoid 92H*a* of the high-pressure electromagnetic valve 92H and a normally-open contact 62*a* of a relay 62 (explained later) are connected in series. In the current path F, a solenoid 92L*a* of the low-pressure electromagnetic vlave 92L and a normally-open contact 63*a* of a relay 63 (explained later) are connected in series. Further, in the current path G, a relay 46 and a normally closed contact 45*a* opened in response to a signal outputted from a stop circuit 45 (explained later) are connected in series. And, a power supply H is connected in parallel with the respective current paths A to G.

The reference numeral 56 denotes a disc fixed to a shaft 55 which rotates once for each revolution of the drive shaft in synchronization with the movement of the drive shaft of the loom. The surface of the disc is divided into two parts 56A and 56B (each 180 degrees) by varying surface color or finishing so as to have varying reflectivity. The reference numeral 57 denotes an optical sensor including a light emitting section and a light-receiving section integrally, being disposed facing the color-divided disc 56, which outputs two electric angular range signals in dependence upon the change in magnitude of received light. Here, the color divided part 56A faces the sensor 57 when the loom is restarted from the loom motion angle between 270 and 90 degrees (closed-shed state) with the minimum closed-shed as its center; the color divided part 56B faces the sensor 57 when the loom is restarted from the loom motion angle between 90 and 270 degrees (open-shed state) with the maximum open shed as its center, so that the sensor 57 outputs two different electric signals, respectively, according to the shed condition.

The output of the optical sensor 57 is connected to a selector 58 via a normally-open contact 54*a* of the relay 54. The selector 58 directly outputs a signal to the set terminal of a bistable multivibrator 59 to reset it when the sensor 57 is activated, and further determines the restarting angle of the loom in accordance with the angular range signals from the sensor 57, and outputs a warp tension signal for selecting one of the high- and low-pressure electromagnetic valves 92H and 92L to an actuator driver 60 according to the determined restarting angle. In response to the timing signal from the bistable multivibrator 59, the relay 61 and the actuator driver 60 are both energized or activated. The actuator driver 60 outputs signals to the relay 62 or 63 in accordance with the selected warp tension signal from the selector 58 only while receiving the timing signal from the bistable multivibrator 59.

The reference numeral 48 is a switch actuating member fixed to a shaft 47 which rotates one for each revolution of the main shaft. The reference numeral 49 denotes a proximity switch, being disposed near the revolution path of the actuating member 48, and outputs a pulse signal whenever the actuating member 48 comes near the proximity switch 49. The reference numeral 50 denotes a counter (divider), which continuously outputs a signal to the reset terminal of the multivibrator 59, until a reset signal is inputted thereto from the stop circuit 45 (explained later), whenever a predetermined number of pulses are inputted thereto from the proximity switch 49. The reference numeral 45 denotes a stop circuit connected to a broken-warp sensor, a weft sensor, a broken selvage-yarn sensor, and a manual loom stopping device (all not shown). When breakage of a warp thread, the misinsertion of a weft thread, or the breakage of a selvage-yarn, etc. has been detected, or when the manual loom-stopping device has been actuated, the stop circuit 45 outputs a signal to the normally-closed contact **45*a* to open it and another signal to the counter 50** to reset it.

Therefore, the relay 46 is deenergized to open all the contacts **46*a*, 46*b*, and 46*c* for stopping the loom, while resetting the counter 50**.

Here, in FIGS. 1 to 3, it is possible to consider that the color-divided discs 56 and the optical sensor 57 are loom-starting angle detection means; the selector 58 is warp-tension selection means; the actuating member 48, the proximity switch 49, the counter 50, and the bistable multivibrator 59 are initial-cycle determination means; the actuator driver is actuator-driving means; the high- and low-pressure governors 91H and 91L, the high- and low-pressure electromagnetic valves 92H and 92L, the three-way electromagnetic valve 36, and the air cylinder 33 are warp-tension increasing means.

The operation will be described hereinbelow.

When the switch 40 is closed to restart the loom, the relay 41 is energized to close the self-holding contact **41*a*, contacts 41*b* and 41*c*, so that the auxiliary devices 65** connected in the current path A are activated.

Since a timer is provided for the contact **41*c*, the current path C is momentarily closed (for instance, about 2 seconds) to energize the relay 54, so that the contact 54*a* is closed. Therefore, the light from the light-emitting section of the optical sensor (including a light emitting and receiving section) 57 is reflected from either of the color-divided portions 56A or 56B of the disc 56, and the sensor 57 outputs an electric angular range signal corresponding to the magnitude of received light to the selector 58**.

Here, if the motion angle of the loom when the loom is restarted is in a closed-shed angular range (270 to 90 degrees), since a dark (low reflection power) color-divided portion 56 faces the sensor 57 as shown in FIG. 3, the magnitude of the received light is small. Therefore, the selector 58 determines a closed-shed angular range in response to the angular range signal and applies a warp tension signal for selecting the electromagnetic valve 92H in the high-pressure pneumatic line 93H to the actuator driver 60.

Simultaneously, since a signal is directly given from the selector 58 to the set terminal of the bistable multivibrator 59 when the contact **54*a* is closed irrespective of the loom motion angle, the bistable multivibrator 59 is triggered to generate a timing signal; the relay 61 is energized to close the contact 61*a* in the current path D, so that the solenoid 36*a* of the three-way electronic valve 36 is energized. Therefore, the three-way electromagnetic valve 36 is opened to connect the pipe 37 with the air cylinder 33. At the same time, the actuator driver 60 is activated in response to the timing signal from the bistable multivibrator 59, and the relay 62 is energized in response to the actuator driving signal from the actuator driver 60. As a result, since the contact 62*a* in the current path E is closed and thus the solenoid 92H*a* of the electromagnetic valve 92H is energized, the electromagnetic valve 92H in the high-pressure line 93H** is opened.

Therefore, air adjusted to a high pressure to apply a greater warp tension appropriate to the warp threads within a closed-shed angular range is supplied into the air cylinder 33 from the pressure governor 91H, so that the piston rod 34 comes out to bring the contact member 35 into contact with the easing lever 6, with the result that the easing lever 6 rotates clockwise. Therefore, the tension applied to the warp threads 2 via the back roller 3 increases, so that the position of cloth fell is adjusted to prevent weft bar which would otherwise result.

Next, if the switch 42 is closed, the relay 43 is energized; the contact **43*a* is closed to self-holding the contact; the main motor 66** begins to rotate.

By this, although the loom is started, since the proximity switch 48 outputs a pulse signal by the aid of the actuating member 48 whenever the main drive shaft rotates one revolution, if the division ratio of the counter 50 is preset to be 2:1, a signal is outputted from the counter 50 once for in every two revolutions of the shaft, that is, every other picks to reset the bistable multivibrator 59. When reset, the output of the bistable multivibrator 59 becomes logically "0", the relays 61 and 62 are deenergized to open the contacts **61*a* and 62*a*. Therefore, the solenoid 36*a* of the three-way electromagnetic valve 36 and the solenoid 92H*a* of the electromagnetic valve 92H are deenergized, so that the valves 36 and 92H** are closed.

In this state, the three-way electromagnetic valve 36 releases the air cylinder 33 to atmospheric; the piston rod 34 goes into the cylinder casing by the spring 38; the contact member 35 is separated away from the easing lever 6, and thereafter the easing lever 6 operates in the same way as when the loom is operated in the steady state.

After an appropriate time period predetermined by the timer built in the normally-open contact **41*c* of the relay 41 has elapsed, the relay 54 is deenergized to open the contact 54*a*, so that the loom-starting angle detection means, the warp-tension selection means, the initial-cycle determination means, and the actuator-driving means are all deactivated, without adjusting the warp tension. By determining this timer period and the division ratio of the counter 50**, it is possible to decide the number of beat-up will occur motions under an additional warp tension after the loom has been started.

If the motion angle of the loom when the loom is restarted is in an open-shed angular range (90° to 270°), a faint (high reflection power) color-divided portion 56B of the disc 56 faces the sensor 57, and the magnitude of the received light is large. Therefore, the selector 58 determines an open-shed angular range in response to the angular range signal and applies a warp tension signal for selecting the electromagnetic valve 92L in the low-pressure pneumatic line 93L to the actuator driver 60. Therefore, the timing signal from the bistable multivibrator 59 energizes the relays 61 and 63 to close the contacts **61*a* and 63*a*, so that the three-way electromagnetic valve 36 and the electromagnetic valve 92L in the low pressure line 93L** are both opened.

Therefore, in this case, air adjusted to a low pressure to apply a smaller warp tension appropriate to the warp threads within an open-shed angular range is supplied into the air cylinder 33 from the pressure governor 91L. Therefore, the applied tension by the air cylinder is reduced a little. Thereafter, the switch 42 is closed to restart the loom and after a predetermined number of picks have been completed, the tension is returned to the original steady state.

When a stop signal is outputted from the stopper circuit 45 while the loom is in operation, the counter 50 is reset; the contact 45*a* of the current path G is opened to deenergize the relay 46; the contacts 46*a*, 46*b*, and 46*c* are all opened and the self-holding of the relays 41 and 42 is also released, so that the auxiliary devices and the main motor are all stopped.

Furthermore, in the embodiment described above, the applied tension is adjusted by using two kinds of circuits (high and low); however, it is obvious that the applied tension can be adjusted by using three or more kinds of circuits where necessary.

A second embodiment according to the present invention will be described hereinbelow with reference to FIGS. 4 to 8.

Figure 4:
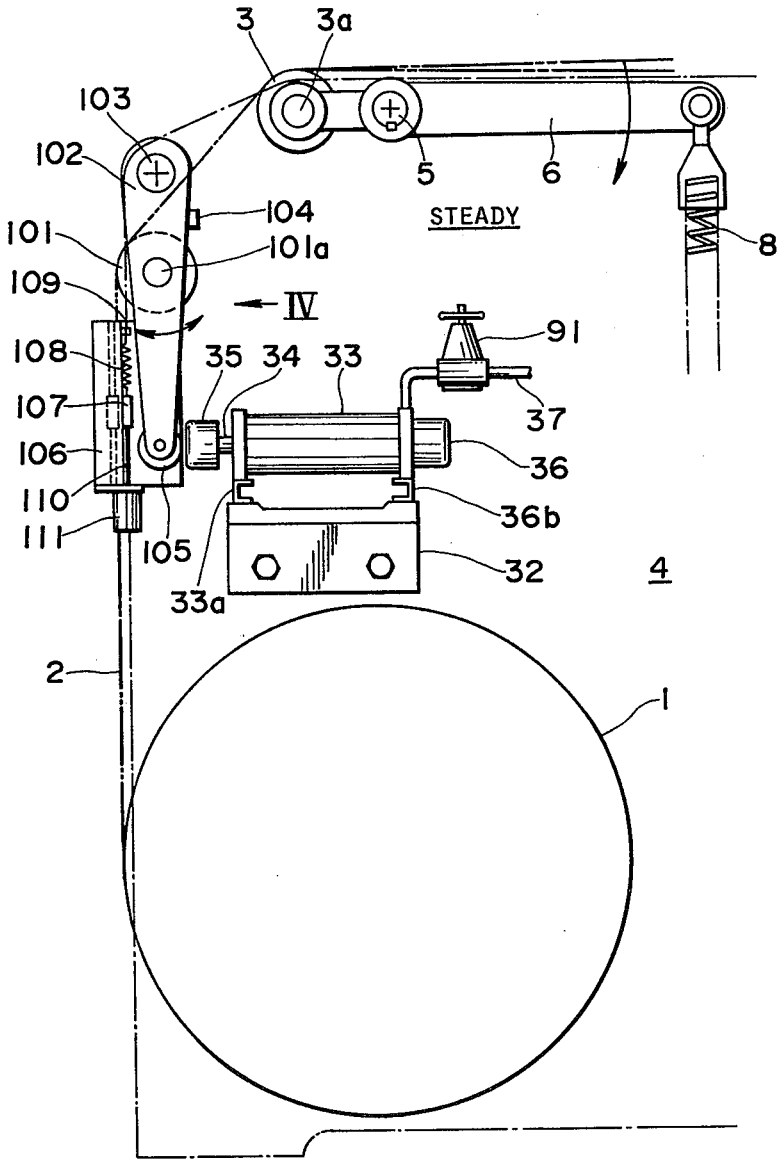
FIG. 4 is a fragmentary side view of a loom showing an essential mechanism portion of a second embodiment of the weft-bar prevention system according to the present invention.

In FIG. 4, the reference numeral 1 denotes a warp beam, the reference numeral 2 denotes warp threads, the reference numeral 3 denotes a back roller, the reference numeral 4 denotes a frame of the loom. The warp threads 2 let-off from the warp beam 1 are guided by the guide roller 101 and the back roller 3, passed through a heald (not shown) and a reed (not shown), and introduced to the cloth fell.

The back roller 3 is rotatably supported by an axle 3*a* fixed to one end portion of an easing lever 6, the intermediate portion of which is fixed to an axle 5 rotatably supported by the frame 4 of the loom. To the other portion of the easing lever 6, a tension spring 8 is engaged. The tension spring 8 urges the lever 6 clockwise in FIG. 4 in order to apply a predetermined tension to the warp threads 2 via the back roller 3. When the thread diameter of the warp beam 1 is reduced as the cloth is being woven, the let-off speed of the warp threads 2 is reduced and the tension applied to the warp threads 2 is thus increased; however, in this case, since the lever 6 is rotated counterclockwise by the back roller 3, the reduction speed ratio in a stepless variable speed gear (not shown) connected to the warp beam 1 is changed, so that the revolution speed of the warp beam 1 is increased and the tension of the warp threads 2 is adjustably corrected, as already explained with reference to FIG. 1.

The guide roller 101 is a member for applying pressure when the loom is restarted, the axle portion 101*a* of which is rotatably supported by the intermediate portion of the guide lever 102. The upper end portion of the guide lever 102 is rotatably supported by an axle 103 fixed to the frame 4. The lever 102 is urged counterclockwise by the tension of the warp threads 2 applied to the guide roller 101 to a position where the lever 102 is brought into contact with a stopper 104 provided on the frame 4. To the lower end portion of the lever 102, a roller 105 is rotatably attached.

On the other hand, to a bracket 32 fixed to the frame 4, an air cylinder 33 serving as a warp tension increasing means is fixed via two supports 33*a* and 33*b*, in such a way that the contact member 35 of the end portion of the piston rod 34 is in contact with the roller 105.

This air cylinder 33 is connected to a pressurized-air supply source (not shown) via a three-way electromagnetic valve 36 and a pressure governor 91. The three-way valve 36 releases pressure from the air cylinder 33 to atmospheric pressure at a normal condition. When the pressure is released to atmospheric, the piston rod 34 of the air cylinder 33 is pulled into the cylinder by the spring. In this three-way electromagnetic valve 36, when the solenoid 36*a* (see FIG. 6) is energized, pressurized air is introduced into the air cylinder 33 to push out the piston rod 34 to bring the contact member 35 in contact with the roller 105, so that the lever 102 is rotated clockwise to move the guide roller 101 in the direction, to increase warp tension.

Figure 5:
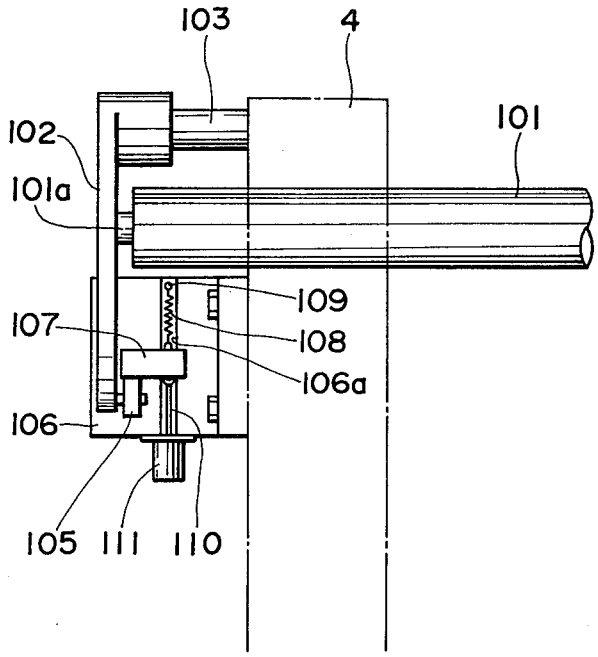
FIG. 5 is a fragmentary rear view of a part of the essential mechanism portion of FIG. 4.

Also, a stopper 106 is fixed to the frame 4 at a position opposite to the air cylinder 33 with respect to the roller 105 in such a way that the roller 105 is brought into contact with the stopper 106 when the air cylinder 33 pushes the roller 105. As depicted in FIG. 5, a part of the auxiliary stopper 107 is engaged in a dovetail groove formed in the stopper 106 in the vertical direction so that the auxiliary stopper 107 is slidable on the stopper 106, and the roller 105 is brought into contact with the auxiliary stopper 107 when the auxiliary stopper 107 is at the lower position. This auxiliary stopper 107 is always urged to the upper position by a spring 108 disposed between the auxiliary stopper 107 and a pin 109 provided at the upper portion of the stopper 106. Further, to the auxiliary stopper 107, an actuator rod 110 of an electromagnetic actuator 111 fixed to the lower portion of the stopper 106 is connected. The electromagnetic acutator 111 pulls the actuator rod 110 to move the auxiliary stopper 107 downward when the solenoid 111*a* (see FIG. 6) is energized.

Figure 6:
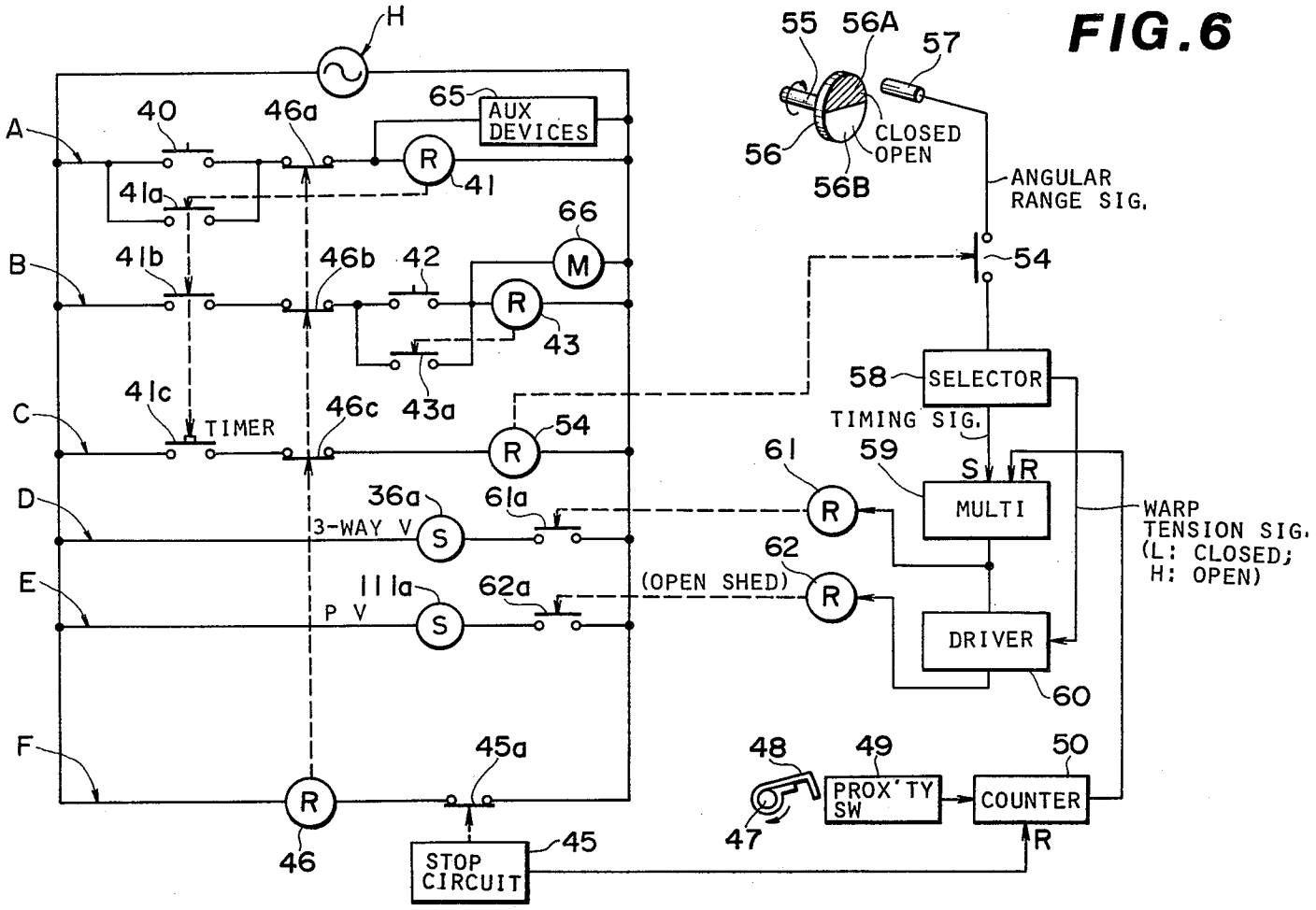
FIG. 6 is a diagram of a circuit for actuating an electromagnetic valve to supply pressurized air, a three-way electromagnetic valve, and an actuator shown in FIG. 4, in order to increase warp tension.

Now, follows a description of the circuit for acutating the three-way electromagnetic valve 36 and the electromagnetic actuator 111 with reference to FIG. 6. In the current path A, a normally-open automatically-reset type push button set switch 40 for starting auxiliary devices 65 (blower, etc.) and a normally-closed contact 46*a* of a relay 46 (explained later) and a relay 41 are connected in series. Further, a normally-open contact 41*a* of the relay 41 is connected in parallel with the switch 40. In the current path B, a normally-open contact 41*b* of the relay 41, a normally-closed contact 46*b* of the relay 46, a normally-open automatically-reset type push button start switch 42 for driving a main motor 66, and a relay 43 are connected in series. Further, a normally-open contact 43*a* of the relay 43 is connected in parallel with the switch 42. In the current path C, a built in timer type normally-open contact 41*c* of the relay 41, a normally-closed contact 46*c* of the relay 46 and a relay 54 are connected in series.

Further, in the current path D, a solenoid 36*a* of the three-way electromagnetic valve 36, and a normally-open contact 61*a* of a relay 61 (explained later) are connected in series. In the current path E, a solenoid 111*a* of the electromagnetic actuator 111 and a normally-open contact 62*a* of a relay 62 (explained later) are connected in series. Further, in the current path F, a relay 46 and a normally closed contact 45*a* opened in response to the signal outputted from a stop circuit 45 (explained later) are connected in series. Finally, a power supply H is connected in parallel with the respective current paths A to F.

The reference numeral 56 denotes a disc fixed to a shaft 55 which rotates once for each revolution of the drive shaft in synchronization with the movement of the drive shaft of the loom. The surface of the disc is divided into two parts 56A and 56B (each 180 degrees) by varying surface color or finishing so as to have varying reflectivity. The reference numeral 57 denotes an optical sensor including a light emitting section and a light-receiving section integrally, being disposed facing the color-divided disc 56, which outputs two electric angular range signals in dependence upon the change in magnitude of received light. Here, the color devided part 56A faces the sensor 57 when the loom is restarted from the loom motion angle between 270 and 90 degrees (closed-shed state) with the minimum closed shed as its center; the color devided part 56B faces the sensor 57 when the loom is restarted from the loom motion angle between 90 and 270 degrees (open-shed state) with the maximum open shed as its center, so that the sensor 57 outputs two different electric signals, respectively, according to the shed motion.

The output of the optical sensor 57 is connected to a selector 58 via a normally-open contact 54*a* of the relay 54. The selector 58 directly outputs a signal to the set terminal of a bistable multivibrator 59 to set it when the sensor 57 is activated, and further determines the restarting angle of the loom in accordance with the angular range signals from the sensor 57, and outputs a H-voltage level warp tension signal to an actuator driver 60 only when the loom is in the open-shed angle range. In response to the timing signal from the bistable multivibrator 59, the relay 61 and the actuator driver 60 are both energized or activated. The actuator driver 60 outputs signals to the relay 62 only while receiving the timing signal from the bistable multivibrator 59 and the H-voltage level warp tension signal from the selector 58.

The reference numeral 48 is a switch-actuating member fixed to a shaft 47 which rotates once for each revolution of the main shaft. The reference numeral 49 denotes a proximity switch, being disposed near the revolution path of the actuating member 48, and outputs a pulse signal whenever the actuating member 48 comes near the proximity switch 49. The reference numeral 50 denotes a counter (divider), which continuously outputs a signal to the reset terminal of the multivibrator 59, until a reset signal is inputted thereto from the stop circuit 45 (explained later), whenever a predetermined number of pulses are inputted thereto from the proximity switch 49. The reference numeral 45 denotes a stop circuit connected to a broken-warp sensor, a weft sensor, a broken selvage-yarn sensor, and a manual loom stopping device (all not shown). When breakage of a warp thread, the misinsertion of a weft thread, or the breakage of a selvage-yarn, etc., has been detected, or when the manual loom-stopping device has been actuated, the stop circuit 45 outputs a signal to the normally-closed contact 45*a* to open it and another signal to the counter 50 to reset it.

Therefore, the relay 46 is deenergized to open all the contacts 46*a*, 46*b*, and 46*c* for stopping the loom, while resetting the counter 50.

Here, in FIGS. 4 to 6, it is possible to consider that the color-divided disc 56 and the optical sensor 57 are loom-starting angle detection means; the selector 58 is warp-tension selection means; the actuating member 48, the proximity switch 49, the counter 50, and the bistable multivibrator 59 are initial-cycle determination means; the actuator driver is actuator-driving means; the tension-applying means (guide roller 101), the three-way electromagnetic valve 36, the air cylinder 33, the electromagnetic actuator 11 are warp-tension increasing means.

The operation will be described hereinbelow.

When the switch 40 is closed to restart the loom, the relay 41 is energized to close the self-holding contact 41*a*, contacts 41*b* and 41*c*, so that the auxiliary devices 65 connected in the current path A are activated.

Since a timer is provided for the contact 41*c*, the current path C is momentarily closed (for instance, about 2 seconds) to energize the relay 54, so that the contact 54*a* is closed. Therefore, the light from the light-emitting section of the optical sensor (including a light emitting and receiving section) 57 is reflected from either of the color-divided portion 56A or 56B of the disc 56, the sensor 57 outputs an electric angular range signal corresponding to the magnitude of received light to the selector circuit 58.

Here, if the motion angle of the loom when the loom is restarted is in a closed-shed angular range (270 to 90 degrees), since a dark (low reflection power) color-divided portion 56 faces the sensor 57 as shown in FIG. 6, the magnitude of the received light is small. Therefore, the selector 58 determines a closed-shed angular range in response to the angular range signal and applies a L-voltage level warp tension signal to the actuator driver 60.

Simultaneously, since a signal is directly given from the selector 58 to the set terminal of the bistable multivibrator 59 when the contact 54*a* is closed irrespective of the loom motion angle, the bistable multivibrator 59 is triggered to generate a timing signal; the relay 61 is energized to close the contact 61*a* in the current path D, so that the solenoid 36*a* of the three-way electronic valve 36 is energized.

At the same time, although the output signal of the bistable multivibrator 59 is given to the actuator 60, since the selector 58 outputs L-voltage level signal, the actuator driver 60 does not energize the relay 61. Therefore, the contact 62*a* in the current path E is kept opened. As a result, the solenoid 111*a* of the electromagnetic actuator 111 is not energized and the electromagnetic actuator 25 is held in inoperative state.

Figure 7:
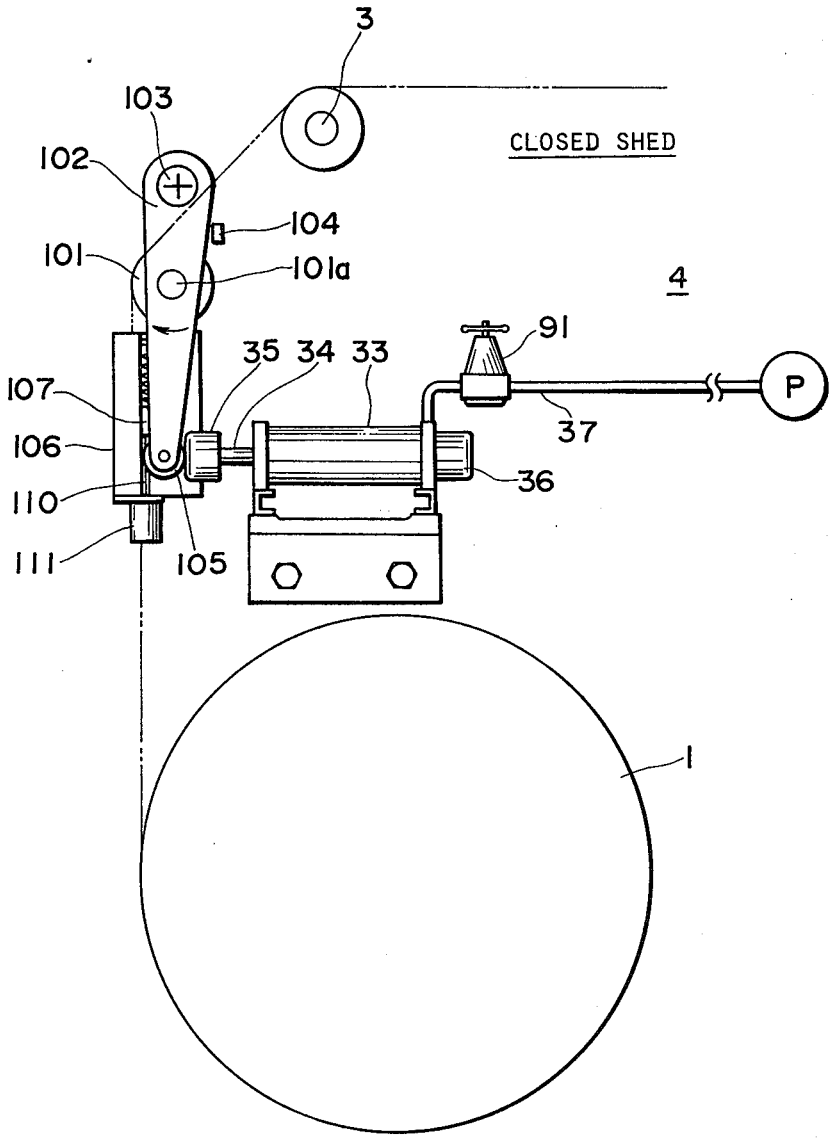
FIGS. 7 and 8 are the same fragmentary side views as in FIG. 4, showing an essential mechanism portion of a second embodiment of the weft-bar prevention system according to the present invention, being classified into two shed states, that is, into a closed-shed state and an open-shed state.

When the three-way electromagnetic valve 36 is opened, pressurized air is introduced into the air cylinder 33. Therefore, as shown in FIG. 7, the piston rod 34 pushes the roller 105 of the guide lever 102 via the contact member 35 to rotate lever 102 clockwise to such a position that the roller 105 is brought into contact with the stopper 106. Accordingly, the guide roller 101 is moved so as to apply a greater warp tension appropriate to the warp threads within a closed-shed angular range. As a result, the position of cloth fell is adjusted, thus preventing weft bar which would otherwise result.

Next, if the switch 42 is closed, the relay 43 is energized; the contact 43*a* is closed to self-holding the contact; the main motor 66 begins to rotate.

By this, although the loom is started, since the proximity switch 48 outputs a pulse signal by the aid of the actuating member 48 whenever the main drive shaft rotates one revolution, if the division ratio of the counter circuit 50 is preset to be 1:1, a signal is outputted from the counter 50 for each revolution of the shaft, that is, from the first pick to reset the bistable multivibrator 59. When reset, the output of the bistable multivibrator 59 becomes logical "0", the relay 61 is deenergized to open the contact 61*a*. Therefore, the solenoid 36*a* of the three-way electromagnetic valve 36 is deenergized, so that the valve 36 is closed.

In this state, the three-way electromagnetic valve 36 releases the air cylinder 33 to atmospheric; the piston rod 34 is pulled into the casing by the spring; and the contact member 35 is not in contact with the roller 105 of the lever 102. Therefore, the guide roller 101 is rotated counterclockwise by the tension of the warp threads 2 together with the lever 102, and the lever 102 is returned to a position to be in contact with the stopper 104. Thereafter, the position of the guide roller 101 is kept at the position in the same way as when the loom is operated in the steady state.

After an appropriate time period predetermined by the timer built in the normally-open contact 41*c* of the relay 41 has elapsed, the relay 54 is deenergized to open the contact 54*a*, so that all the elements or units are deactivated, without adjusting the warp tension.

Also, if the motion angle of the loom when the loom is restarted is in an open-shed angular range (90° to 270°), since a faint (high reflection power) color-divided portion 56B of the disc 56 faces the sensor 57, the magnitude of the received light is large. Therefore, the selector 58 determines an open-shed angular range in response to the angular range signal and applies a H-voltage level warp tension signal for actuating the electromagnetic actuator 111 to the actuator driver 60. Therefore, the timing signal from the bistable multivibrator 59 energizes the relay 61 to close the contact 61*a*, so that the solenoid 36*a* of the three-way electromagnetic valve 36 is energized; the actuator driver 60 is also activated by the timing signals from the bistable multivibrator 59 and the H-voltage level signal from the selector 58 to energize the relay 62. Therefore, the contact 62*a* is closed to energize the solenoid 111*a* of the electromagnetic actuator 111.

Figure 8:
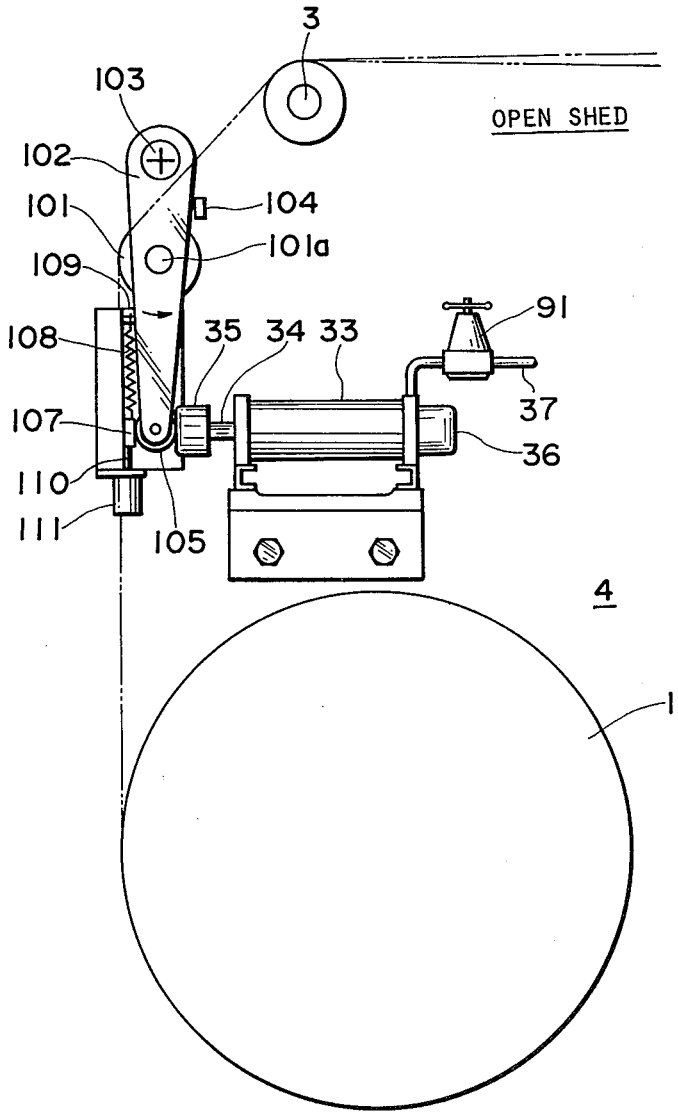

Therefore, in this case, as shown in FIG. 8, although the piston rod 34 of the air cylinder 33 pushes the roller 105 of the guide lever 102 by the opening operation of the three-way electromagnetic valve 36; however, since the electromagnetic actuator 111 operates to pull the actuator rod 110 to move the auxiliary stopper 107 connected to the rod 110 downward, the roller 105 of the lever 102 is pinched between the contact member 35 of the piston rod 34 and the auxiliary stopper 107. Therefore, the movement of the lever 102 is reduced, and the travel of the guide roller 101 is also reduced. The tension applied to the warp threads 2 is reduced to that appropriate within an open-shed angular range. Thereafter, the switch 42 is closed to restart the loom, and after a predetermined number of picks have been completed, the tension is returned to the original state.

When a stop signal is outputted from the stopper circuit 45 while the loom is in operation, The counter circuit 50 is reset; the contact 45*a* of the electric path F is opened to deenergize the relay 46; the contacts 46*a*, 46*b*, and 46*c* are all opened and the self-holding of the relays 41 and 43 is also released, so that the auxiliary devices and the main motor are all stopped.

Furthermore, in the embodiment described above, the applied tension is adjusted by using one auxiliary stopper; however, it is obvious that the applied tension can be adjusted by using three or more kinds of auxiliary stopper where necessary.

In the second embodiment described above, although the tension to be applied to the warp threads is increased by moving the guide roller 101 with the air cylinder 33, it is also possible to increase the tension to be applied to the warp threads by forcedly moving the back roller 3 via the lever 6. In this case, the movement of the back roller 3 is also controlled according to the restarting angle.

As described above, in the weft-bar prevention system according to the present invention, since the loom motion angle is first detected by the loom-starting angle detection means and since a greater additional tension is applied to the warp threads for one or two cycles by the warp-tension increasing means when the loom is restarted from the closed-shed state or a smaller additional tension is applied to the warp threads only for one or two cycles by the warp-tension increasing means when the loom is restarted from the open-shed state, it is possible to prevent a weft-bar caused when the loom is immediately restarted after the loom has been stopped due to weft- or warp-thread cut. Further, in this invention, since it is possible to restart the loom immediately after the loom has been repaired, it is possible to improve productivity.

It will be understood by those skilled in the art that the foregoing description is in terms of preferred embodiments of the present invention wherein various changes and modifications may be made without departing from the spirit and scope of the invention, as set forth in the appended claims.

What is claimed is:

1. A weft-bar prevention system for a loom in which warp threads let-off from warp beams are guided to a cloth fell under an appropriate warp tension by the aid of an elastically supported guide member, which comprises:

(a) loom-starting angle detection means for detecting at least two angular ranges of a drive shaft of the loom when the loom is started and outputting angular range signals corresponding thereto;

(b) warp-tension selection means for selecting a warp tension signal in accordance with each of the angular range signals outputted from said loom-starting angle detection means and outputting a warp tension signal corresponding thereto;

(c) initial-cycle determination means for determining at least one initial cycle during which warp tension is additionally applied after the loom has been started and outputting a timing signal only during the at least one initial cycle determined thereby;

(d) actuator-driving means for outputting at least one actuator driving signal in response to the warp tension signal from said warp-tension selection means only while said initial-cycle determination means is outputting a timing signal thereto; and (e) warp-tension increasing means for increasing tension to be applied to the warp threads in response to at least one actuator driving signal outputted from said actuator-driving means, whereby additional tensions are applied to the warp threads according to the angular ranges of the loom for at least one initial cycle after the loom has been started.

2. A weft-bar prevention system for a loom as set forth in claim 1, wherein said loom-starting angle detection means comprises:

(a) a color-divided disc connected to a drive shaft of the loom for rotating in synchronization with the revolution of the loom, one flat surface of which is divided into at least two colored ranges so as to provide at least two different reflectivities; and (b) an optical sensor disposed so as to face one of the color-divided ranges of said color-divided disc, said optical sensor including a light emitting section and a light-receiving section for outputting signals indicative of angular ranges of the loom according to the magnitude of the light emitted therefrom, reflected from said disc, and received thereby.

3. A weft-bar prevention system for a loom as set forth in claim 1, wherein said initial-cycle determination means comprises:

(a) a switch-actuating member mechanically connected to the drive shaft of the loom for rotating in synchronization with the revolution the loom;

(b) a proximity switch disposed near the circular path of said switch-actuating member for outputting a turned-on signal for each revolution of said switch-actuating member;

(c) a counter connected to said proximity switch for counting the number of signals outputted from said proximity switch and outputting a signal whenever a predetermined number of signals are inputted thereto; and (d) a bistable multivibrator connected to said warp tension selection means, said actuator-driving means and said counter, which is set when said loom-starting angle detection means is activated and reset when said counter outputs a signal thereto, said bistable multivibrator activating said actuator-driving means when set but deactivating it when reset.

4. A weft-bar prevention system for a loom as set forth in claim 1, wherein said warp tension increasing means comprises:

(a) at least two pressure governors for producing at least two kinds of pressurized air sources;

(b) at least two electromagnetic valves each pneumatically connected to one of said at least two pressure governors for supplying the at least two pressurized air sources, respectively, in response to the actuator driving signal outputted from said actuator-driving means;

(c) a three-way electromagnetic valve pneumatically connected to said at least two electromagnetic valves and a source of atmospheric pressure, said three-way valve being communicated with said at least two electromagnetic valves in response to the timing signal outputted from said initial-cycle determination means and released to atmospheric pressure when said initial-cycle determination means outputs no signal; and (d) an air cylinder pneumatically connected to said three-way electromagnetic valve for moving the guide member in such a direction that warp thread tension is increased to a degree determined by one of the pressurized air sources introduced thereinto when the timing signal from said initial-cycle determination means is applied to said three-way electromagnetic valve and when one of at least two actuator driving signals from said actuator-driving means is applied to one of said at least two electromagnetic valves, said air cylinder being released to atmospheric pressure via said three-way electromagnetic valve to such a degree that no additional tension is applied to the warp threads when said initial-cycle determination means outputs no signal.

5. A weft-bar prevention system for a loom as set forth in claim 1, wherein said warp tension increasing means comprises:

(a) a tension-applying means for applying an additional tension to the warp threads;

(b) a pressure governor for producing a pressurized air source;

(c) a three-way electromagnetic valve pneumatically connected to said pressure governor in response to the timing signal from said initial-cycle determination means and released to atmospheric pressure when said initial-cycle determination means outputs no signal;

(d) an air cylinder pneumatically connected to said three-way electromagnetic valve for moving said tension-applying means in such a direction that warp thread tension is increased when the timing signal from said initial-cycle determination means is applied to said three-way electromagnetic valve to introduce pressurized air source thereinto, said air cylinder releasing said tension-applying means when the timing signal is not applied to said three-way electromagnetic valve; and (e) an electromagnetic actuator mechanically engaged with said tension-applying means for releasing said tension-applying means to a first tension position when the timing signal from said initial-cycle determination means is applied to said three-way electromagnetic valve to introduce pressurized air source thereinto and when said actuator is deenergized in response to one of the actuator driving signals from said actuator-driving means and for urging said tension-applying means to a second tension position when the timing signal from said initial-cycle determination means is applied to said three-way electromagnetic valve to introduce pressurized air source thereinto and when said actuator is energized in response to another of the actuator driving signals from said actuator driving means.

6. A weft-bar prevention system for a loom in which warp threads let-off from warp beams are guided to a cloth fell under an appropriate warp tension by the aid of an elastically supported guide member which comprises:

(a) a color-divided disc connected to a drive shaft of a loom for rotating in synchronization with the movement of the loom, one flat surface of which is divided into two different colored ranges respectively indicative of a closed-shed angular range and an open-shed angular range;

(b) an optical sensor disposed facing one of the two different colored ranges, said optical sensor including a light-emitting section and a light-receiving section for outputting two angular range signals indicative of the closed-shed angular range and the open-shed angular range, respectively, according to the magnitude of the light emitted therefrom, reflected from said color-divided disc, and received thereby;

(c) a selector connected to said optical sensor for selecting one of a closed-shed warp tension signal and an open-shed warp tension signal in accordance with the two angular range signals from said optical sensor and outputting signals corresponding thereto;

(d) a bistable multivibrator connected to said selector, said multivibrator being set via said selector to output a timing signal when said optical sensor is activated;

(e) an actuator driver connected to said bistable multivibrator and said selector for outputting one of a closed-shed warp tension signal and an open-shed warp tension signal only while said bistable multivibrator is outputting a timing signal;

(f) a high-pressure governor for producing a predetermined high-pressure air source;

(g) a low-pressure governor for producing a predetermined low-pressure air source;

(h) a high-pressure electromagnetic valve pneumatically connected to said high-pressure governor for supplying the high-pressure air source in response to the closed-shed warp tension signal from said actuator driver;

(i) a low-pressure electromagnetic valve pneumatically connected to said low-pressure governor for supplying the high-pressure air source in response to the open-shed warp tension signal from said actuator driver;

(j) a three-way electromagnetic valve pneumatically connected to said two high- and low-pressure electromagnetic valves and a source of atmospheric pressure, said three-way valve being pneumatically connected to said high- and low-pressure electromagnetic valves in response to the timing signal from said bistable multivibrator and released to atmospheric pressure when said bistable multivibrator outputs no signal; and (k) an air cylinder pneumatically connected to said three-way electromagnetic valve for moving the guide member in such a direction that warp thread tension is increased to a degree determined by high-pressure air introduced thereinto when the timing signal from said bistable multivibrator is applied to said three-way electromagnetic valve and when the closed-shed warp tension signal is applied to said high-pressure electromagnetic valve to supply high-pressure air thereinto; and to a degree determined by low-pressure air introduced thereinto when the timing signal from said bistable multivibrator is applied to said three-way electromagnetic valve and when the open-shed warp tension signal is applied to said low-pressure electromagnetic valve to supply a low-pressure air thereinto.

7. A weft-bar prevention system for a loom in which warp threads let-off from warp beams are guided to a cloth fell under an appropriate warp tension by the aid of an elastically supported guide member which comprises:

(a) a color-divided disc connected to a drive shaft of a loom for rotating in synchronization with the movement of the loom, one flat surface of which is divided into two different colored ranges respectively indicative of a closed-shed angular range and an open-shed angular range;

(b) an optical sensor disposed facing one of the two different colored ranges, said optical sensor including a light-emitting section and a light-receiving section for outputting two angular range signals indicative of the closed-shed angular range and the open-shed angular range, respectively, according to the magnitude of the light emitted thereform, reflected from said color-divided disc, and received thereby;

(c) a selector connected to said optical sensor for selecting one of a closed-shed warp tension signal and an open-shed warp tension signal in accordance with the two angular range signals from said optical sensor and outputting signals corresponding thereto;

(d) a bistable multivibrator connected to said selector, said multivibrator being set via said selector to output a timing signal when said optical sensor is activated;

(e) an actuator driver connected to said bistable multivibrator and said selector for outputting one of a closed-shed warp tension signal and an open-shed warp tension signal only while said bistable multivibrator is outputting a timing signal;

(f) tension-applying means for applying an additional tension to the warp threads;

(g) a pressure governor for producing a pressurized air source;

(h) a three-way electromagnetic valve pneumatically connected to said pressure governor in response to the timing signal from said bistable multivibrator and released to atmospheric pressure when no timing signal is outputted from said bistable multivibrator;

(i) an air cylinder pneumatically connected to said three-way electromagnetic valve for moving said tension-applying means in such a direction that warp thread tension is increased when the timing signal from said bistable multivibrator is applied to said three-way electromagnetic valve to introduce pressured air thereinto, said air cylinder releasing said tension-applying means when the timing signal is not applied to said three-way electromagnetic valve; and (j) an actuator mechanically engaged with said tension-applying means for releasing said tension-applying means to a greater-tension position when the timing signal from said bistable multivibrator is applied to said three-way electromagnetic valve to introduce pressurized air thereinto and when the closed-shed warp tension signal is applied to said actuator drive to deenergize said actuator; and for urging said tension-applying means to a smaller-tension position when the timing signal from said bistable multivibrator is applied to said three-way electromagnetic valve to introduce pressurized air thereinto and when the open-shed warp tension signal is applied to said actuator driver to energize said actuator.

8. A weft-bar prevention system for a loom as set forth in either of claim 6 or 7, which further comprises:

(a) a switch-actuating member connected to a drive shaft of the loom for rotating in synchronization with the revolution of the loom;

(b) a proximity switch disposed near the circular path of said switch-actuating member for outputting a signal for each revolution of said switch-actuating member; and (c) a counter connected to said proximity switch for counting the number of signals from said proximity switch and outputting a signal to the reset terminal of said bistable multivibrator to reset said bistable multivibrator whenever a predetermined number of signals are inputted thereto.

9. A weft-bar prevention system for a loom as set forth in claim 7, wherein said tension-applying means comprises:

(a) a guide lever, one end of which is rotatably supported at an appropriate position of a frame of the loom;

(b) a guide roller rotatably mounted at the nearly intermediate portion of said guide lever in such a way that a tension applied to warp threads can be adjusted when oscillated; and (c) a roller rotatably mounted on the other end of said guide roller in such a way that said roller is in contact with said air cylinder; and wherein said actuator comprises:

(a) a stopper disposed so as to restrict the movement of said tension-applying means;

(b) an auxiliary stopper;

(c) a spring connected to said auxiliary stopper; and (d) an electromagnetic actuator for releasing said auxiliary stopper to a greater-tension position where said roller is pinched between said stopper and said air cylinder when the timing signal from said bistable multivibrator is applied to said three-way electromagnetic valve to introduce pressured air into the air cylinder and thus causing said air cylinder to push said roller to said stopper and when the closed-shed warp tension signal is applied to said actuator driver to deenergize said actuator, and for actuating said auxiliary stopper to a smaller-tension position where said roller is pinched between said auxiliary stopper and said air cylinder when the timing signal from said bistable multivibrator is applied to said three-way electromagnetic valve to introduce pressurized air into the air cylinder and thus to cause said air cylinder to push said roller to said auxiliary stopper and when the open-shed warp tension signal is applied to said actuator driver to energize said actuator.

10. A method of preventing weft-bar in a loom caused when a loom is started, which comprises the following steps of:

(a) detecting whether the loom is started within a closed-shed range of loom movement or in an open-shed range of loom movement;

(b) outputting a closed-shed warp tension signal when the loom is started from the closed-shed range and an open-shed warp tension signal when the loom is started from the open-shed range;

(c) determining at least one initial cycle during which warp tension is controlled after the loom has been started and outputting a timing signal for determined at least one initial cycle;

(d) increasing the warp tension to a greater degree in response to the closed-shed warp tension signal and to the timing signal;

(e) increasing the warp tension to a smaller degree in response to the open-shed warp tension signal and to the timing signal; and (f) not increasing the warp tension after the determined at least one initial cycle, whereby additional tensions are applied to the warp threads according to the angular ranges of the loom for at least one initial cycle after the loom has been started.

* * * * *